US005950270A

United States Patent [19]

Tono

[11] Patent Number: 5,950,270

[45] Date of Patent: Sep. 14, 1999

[54] RESILIENT DRIVE COUPLING FOR FLOOR POLISHING MACHINE WHEELS

[76] Inventor: Gianni Tono, 11, via Locchi, Padua, Italy, 35124

[21] Appl. No.: 08/890,561

[22] Filed: Jul. 9, 1997

[30] Foreign Application Priority Data

Feb. 14, 1997 [IT] Italy ..... PD97 A000028

[51] Int. Cl.[6] ..... A47L 11/162

[52] U.S. Cl. ..... 15/98

[58] Field of Search ..... 15/49.1, 50.1, 15/52, 98

[56] References Cited

U.S. PATENT DOCUMENTS

| | | | |
|---|---|---|---|
| D. 223,945 | 6/1972 | Bousquet | 15/49.1 |
| 2,774,089 | 12/1956 | Brown | 15/98 |
| 3,397,419 | 8/1968 | Okun | 15/49.1 |
| 5,579,554 | 12/1996 | Plazanet | 15/98 |

FOREIGN PATENT DOCUMENTS

| | | | |
|---|---|---|---|
| 640875 | 1/1937 | Germany | 15/49.1 |
| 0630379 | 10/1978 | U.S.S.R. | 15/98 |

*Primary Examiner*—Randall E. Chin
*Attorney, Agent, or Firm*—Dowell & Dowell, P.C.

[57] ABSTRACT

The invention is a single-wheel floor-polishing machine provided with drive wheel comprising two coaxial, opposite cup-shaped elements connected with each other by means of one or more traction elastic elements suitable for raising the polishing wheel from the floor. The upper cup is mechanically connected with the electric motor and the lower cup is connected with the rigid rotary plate that supports the polishing wheel. The polishing wheel rotation generates a centrifugal air vortex under the polishing wheel itself, which results in the formation of an area below normal atmospheric pressure, as a consequence of which the polishing wheel is attracted to the floor. In the starting phase the polishing wheel is raised from the ground and free to rotate; the polishing wheel does not overheat because the pressure is automatically regulated according to the polishing wheel rotation speed, to the type of floor and to the elasticity of the traction springs.

17 Claims, 1 Drawing Sheet

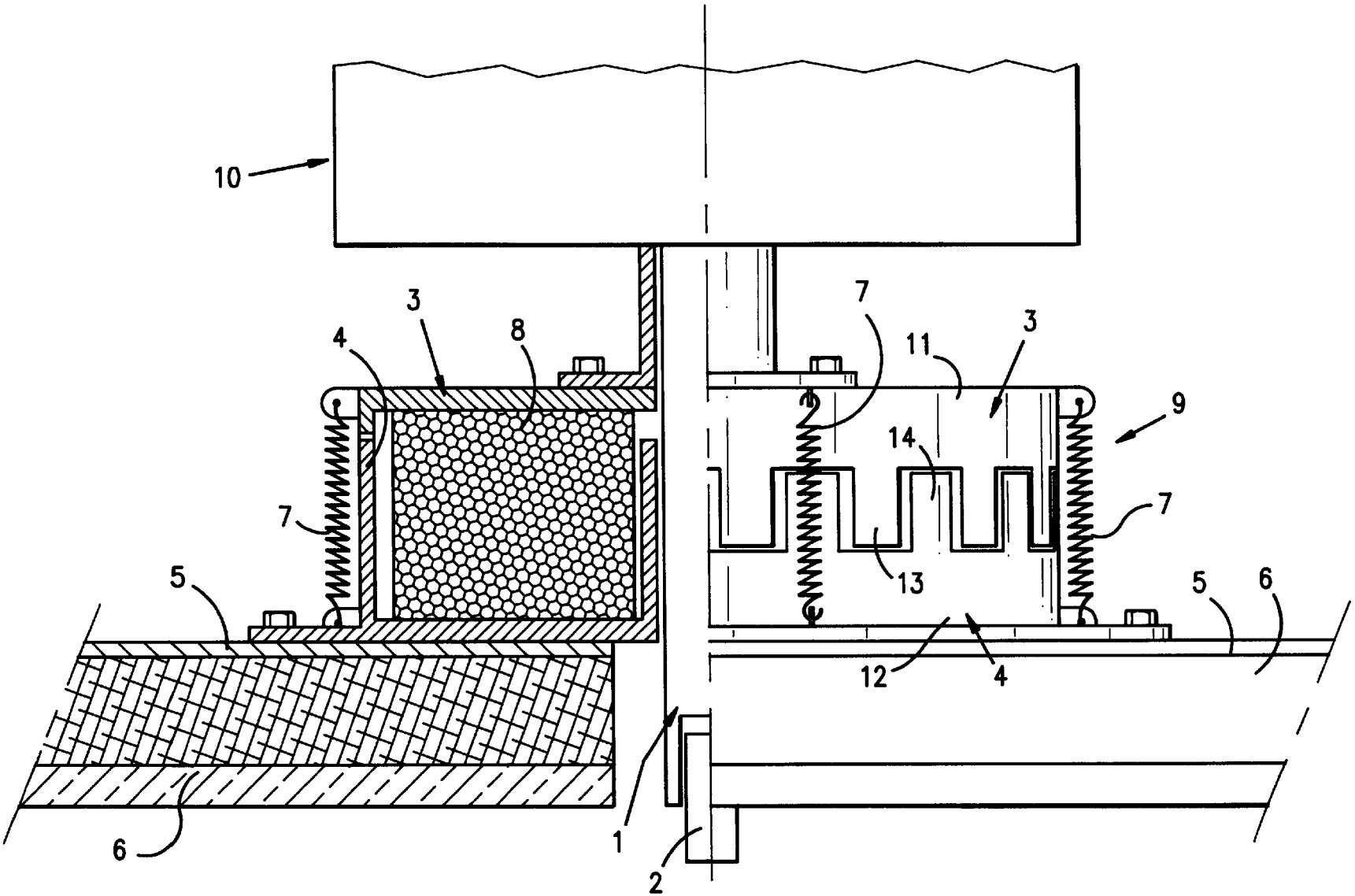
1
2
3
4
5
6
7
8
9
10
11
12
13
14

RESILIENT DRIVE COUPLING FOR FLOOR POLISHING MACHINE WHEELS

BACKGROUND OF THE INVENTION

1. Field of the Invention

The present invention concerns floor polishing machines and in particular floor polishing machines with only one brush wheel rotating about a vertical axis.

2. Description of Related Art

At present, to polish the floor of houses, offices, laboratories, etc. polishing machines are used which are equipped with a horizontal polishing wheel comprising a rigid or semi-rigid rotary plate on which a layer of elastic material and a layer of soft polishing material, for example, felt, are applied. These machines are provided with a front castor and two rear, non-swivelling wheels that support the weight of the machines. During transport, a polishing wheel is completely raised from the floor and the rear wheels make it possible to transport a machine even on rough floors. During use, all the wheels rest on the floor and the pressure of the polishing wheel against the floor is obtained by adjusting the height of the front castor. One of the drawbacks of such a machine is that it is not possible to obtain an even contact of the polishing wheel with the floor. In fact, the contact is only partial, due to the inclination caused by the front castor. In some cases an adjustable castor is used at the center of the polishing wheel and the pressure against the floor adjusted either manually or by means of thrust springs. In both cases, the contact of the polishing wheel is even, however, to avoid excessive current usage in the operation of the machine, it is necessary to reduce the force against the floor, thus reducing the polishing action as well.

These known floor polishing machines present other drawbacks such as upon starting, the polishing wheel must overcome static friction, therefore the motor requires more electric current and this results in unacceptable consequences when considering the technical specifications required by users and by regulations in force. Furthermore, in certain situations, the load placed on an electrical circuit may cause circuit breakers to interrupt electric energy flow to other equipment like computers, machine tools, etc. Also, if the polishing wheel meets an obstacle on the floor, such as an unevenness of the floor, badly jointed marble slabs, expansion joints between different kinds of floors, its rotational speed is reduced and a greater load is place on the motor requiring an increase in electric energy consumption. Further, although it is possible to adjust the pressure exerted by the polishing wheel on the floor, the position of the polishing wheel with respect to the floor is often inclined and therefore the friction of the polishing wheel on the floor is not proper and the polishing action is reduced. Therefore, the operator must notice if the pressure exerted by the polishing wheel is insufficient or excessive, checking if the floor on which the machine has just passed is polished (insufficient pressure, considerable presence of wax on the floor) or if the motor rotates with difficulty and the machine resists its own advancement (excessive pressure, sticking of the polishing wheel to the wax on the floor).

SUMMARY OF THE INVENTION

In order to eliminate all the above mentioned inconveniences, a floor polishing machine has been designed and implemented which is provided with a new type of drive joint or coupling for polishing wheels. The new drive coupling automatically raises the polishing wheel from the floor when it is not rotating at a predetermined rate and lowers it only when it rotates at a speed which is suitable for use.

The new drive coupling for polishing wheels comprises a first driving cup or housing section mechanically connected with an electric motor and a second driven cup or housing section connected with a rigid rotary plate of the polishing wheel, a vibration-damping joint intermediate the first and second housing sections and one or more traction springs which are suitable for raising the polishing wheel from the floor and which support the second housing section from the first housing section.

In operation, when the polishing wheel rotational speed increases, a centrifugal air vortex is generated in the underlying area between the polishing wheel and the floor and the vortex moves the air from under the polishing wheel thus creating an area below normal atmospheric pressure. When, as the polishing wheel rotation speed increases, the low pressure area overcomes the spring resistance and the polishing wheel is lowered until it thoroughly engages the floor and can thus polish it correctly. When the motor is stopped or slowed, the polishing wheel decelerates and the low pressure area under the polishing wheel diminishes and the springs raise the polishing wheel from the floor.

BRIEF DESCRIPTION OF THE DRAWINGS

The single drawing figure is a partial cross sectional front plan view of the floor polishing machine of the present invention.

DESCRIPTION OF THE PREFERRED EMBODIMENT

The drawing figure shows a drive coupling 9 for a floor polishing machine which includes an upturned cup or driven housing section 4, drilled at its center, is coaxially and firmly installed about a central rod 1 which is provided with a castor 2 mounted on its lower part and which normally supports the polishing machine relative to the floor. The first upturned cup or housing section 3, hereinafter called driving housing section, is rotated by an electric motor 10 of the floor-polishing machine. The second cup or housing section, hereinafter called driven housing section, is installed about the same rod 1 and can slide axially relative to the rod. The driven housing section also is drilled at its center and is connected with a rigid rotary plate 5 of the polishing wheel 6 either directly or by means of connecting elements. Both of the driving and the driven housing sections have their side or peripheral walls 1 1 and 12, respectively, provided with square teeth 13 and 14 which are positioned very near each other so that the teeth of one housing section fit into the gaps between the teeth of the other housing section. The two housing sections are normally retained near each other by two or more traction springs 7 or by other elastic elements.

A vibration-damping joint or material 8 is positioned between the two housing sections, inside the toothed edges, and, if necessary, the material is fixed to one of the housing sections in such a way as to damp the forces transmitted between the driven and the driving housing sections.

The new drive coupling is fixed to the central rod of the floor-polishing machine so that the polishing wheel is slightly raised from the ground or floor. When the motor of the floor-polishing machine is operated, the driving housing section rotates and causes the driven housing section connected with the polishing wheel to also rotate. When the polishing wheel rotational speed increases, a centrifugal air vortex is generated in the underlying area between the polishing wheel and the floor and the vortex moves the air from under the polishing wheel thus creating an area below normal atmospheric pressure. When, as the polishing wheel rotation speed increases, the low pressure overcomes the spring resistance the polishing wheel is lowered until it thoroughly engages the floor and can thus polish it correctly. When the motor is stopped or slowed, the polishing wheel diminishes and the springs raise the polishing wheel from the floor.

The new drive joint for polishing wheels prevents the excessive use of current during start up and the consequent operation of the current overload switches of the electric system. As the polishing wheel is raised from the floor and there is no static friction to overcome at start up, the current necessary for the start is less than that required by other floor-polishing machines. Another important advantage is the reduction of the load or force on the floor due to motor rpm reduction. There is also no overheating of the polishing wheel as a consequence of excessive pressure exerted on the polishing wheel since, with the new drive coupling, the pressure depends on the polishing wheel rotational speed. If the friction between the polishing wheel and the floor increases, the polishing wheel decelerates and the springs will raise it until it reaches the correct speed again and once again engages the floor.

If the polishing wheel meets any rough or disjointed point on the floor, it decelerates and is raised as described above. The pressure exerted by the polishing wheel on the floor is adjusted almost automatically. If the pressure is insufficient as the speed increases the polishing wheel, due to the effect of the low pressure area, the polishing wheel will be drawn towards the floor, while if the pressure is excessive, the frictional engagement with the wax makes the polishing wheel decelerate and it is raised by the springs.

Therefore, the single-wheel floor polishing machine is provided with a new drive coupling comprising two cup-shaped housing sections that are connected with each other, coaxially and oppositely oriented. The upper housing section is mechanically connected with the electric motor and the lower housing section is connected with the rigid rotary plate that supports the polishing wheel. The two housing sections are brought near each other by means of one or more traction elastic elements which are suitable for lifting the polishing wheel from the floor. The elastic elements may be one or more springs connected with the upper housing section and with the lower housing section.

The above are the basic outlines of the invention on the basis of which a technician will be able to provide for implementations. Therefore, any change which may be necessary upon implementation is to be regarded as completely protected by the present invention.

I claim:

1. A floor polishing machine comprising, a polishing wheel normally elevated at a first Position above a wheel means relative to a support surface and a drive motor, a drive coupling connecting said polishing wheel to said drive motors said drive coupling including a driving housing section connected to said drive motor so as to be rotatable about an axis and a driven housing section to which said polishing wheel is secured, means for elastically connecting said driven housing section to said driving housing section such that said driven housing section is rotatable about said axis and axially moveable from said first position and away from said driving housing section at a predetermined rotational velocity of said driven housing section to a second position so that said polishing wheel moves relative to said wheel means into engagement with the support surface in said second position.

2. The floor polishing machine of claim 1 in which said drive coupling includes means for damping vibrations between said driving housing section and said driven housing section.

3. The floor polishing machine of claim 2 in which said means for damping vibrations includes a damping material mounted intermediate said driving housing section and said driven housing section.

4. The floor polishing machine of claim 2 in which said means for elastically connecting includes at least one spring element.

5. The floor polishing machine of claim 4 including a rod extending along said axis, each of said driving housing section and said driven housing section being mounted so as to be rotatable about said rod.

6. The floor polishing machine of claim 5 wherein said wheel means is mounted to an end of said rod such that said wheel means projects outwardly beyond an outer surface of said polishing wheel when said driven housing section is retained in said first position and proximate to said driving housing section by said resilient means.

7. The floor polishing machine of claim 6 in which each of said driving housing section and said driven housing section include peripheral walls, each of said peripheral walls including a plurality of projecting elements spaced relative to one another such that said projecting elements of said peripheral wall of said driving housing section are spaced intermediate said projecting elements of said peripheral wall of said driven housing section.

8. The floor polishing machine of claim 1 including a rod extending along said axis, each of said driving housing section and said driven housing section being mounted so as to be rotatable about said rod.

9. The floor polishing machine of claim 8 wherein said wheel means is mounted to an end of said rod such that said wheel means projects outwardly beyond an outer surface of said polishing wheel when said driven housing section is retained in said first position and proximate to said driving housing section by said resilient means.

10. The floor polishing machine of claim 9 in which each of said driving housing section and said driven housing section include peripheral walls, each of said peripheral walls including a plurality of projecting elements spaced relative to one another such that said projecting elements of said peripheral wall of said driving housing section are spaced intermediate said projecting elements of said peripheral wall of said driven housing section.

11. The floor polishing machine of claim 1 in which each of said driving housing section and said driven housing section include peripheral walls, each of said peripheral walls including a plurality of projecting elements spaced relative to one another such that said projecting elements of said peripheral wall of said driving housing section are spaced intermediate said projecting elements of said peripheral wall of said driven housing section.

12. A floor polishing machine comprising, a polishing wheel and a drive motor, a drive coupling connecting said polishing wheel to said drive motor, said drive coupling including a driving member connected to said drive motor so as to be rotatable about an axis and a driven member to which said polishing wheel is secured, an elastic means for connecting said driven member to said driving member such that said driven member is rotatable about said axis and axially moveable relative to said driving housing section from a first position adjacent said driving member to a second position spaced therefrom depending upon the rotational velocity of said driven housing section, a rod extending along said axis, and each of said driving member and said driven member being mounted so as to be rotatable about said rod.

13. The floor polishing machine of claim 12 in which said drive coupling includes means for damping vibrations between said driving member and said driven member.

14. The floor polishing machine of claim 13 in which said means for damping vibrations includes a damping material mounted intermediate said driving member and said driven member.

15. The floor polishing machine of claim 12 in which said elastic means includes at least one spring element.

16. The floor polishing machine of claim 12 in which each of said driving member and said driven member include peripheral walls, each of said peripheral walls including a plurality of projecting elements spaced relative to one another such that the projecting elements of said peripheral wall of said driving member are spaced intermediate said projecting elements of said peripheral wall of said driven member.

17. The floor polishing machine of claim 12 including a roller means mounted to an end of said rod such that said roller means projects outwardly beyond an outer surface of said polishing wheel when said driven member is retained in said first position adjacent said driving member by said resilient means.

* * * * *